US006520445B2

(12) United States Patent
Araujo

(10) Patent No.: US 6,520,445 B2
(45) Date of Patent: Feb. 18, 2003

(54) COIL WRAPPING MACHINE

(76) Inventor: Luiz Henrique Araujo, Rua Saint Martin, 31-3, 174043-081 Bauru, Sao Paulo (BR)

( * ) Notice: Subject to any disclaimer, the term of this patent is extended or adjusted under 35 U.S.C. 154(b) by 33 days.

(21) Appl. No.: 09/729,382

(22) Filed: Dec. 4, 2000

(65) Prior Publication Data

US 2001/0030256 A1 Oct. 18, 2001

Related U.S. Application Data

(60) Provisional application No. 60/169,070, filed on Dec. 6, 1999.

(51) Int. Cl.[7] ..... B65H 81/02
(52) U.S. Cl. ..... 242/434.5; 53/204; 53/588
(58) Field of Search ..... 242/434, 434.5, 242/434.7, 444; 53/204, 588

(56) References Cited

U.S. PATENT DOCUMENTS

| | | | | | |
|---|---|---|---|---|---|
| 1,876,815 | A | * | 9/1932 | Wilson et al. | 242/434.5 |
| 2,254,934 | A | * | 9/1941 | Brown | 242/434.5 |
| 2,630,751 | A | * | 3/1953 | Cranston et al. | 53/204 |
| 4,768,725 | A | * | 9/1988 | Daines et al. | 242/434.5 |
| 5,027,581 | A | * | 7/1991 | Kovacs | 53/588 |
| 5,282,347 | A | * | 2/1994 | Cleine et al. | 53/204 |
| 5,829,234 | A | * | 11/1998 | Suolahti | 53/556 |
| 6,192,653 | B1 | * | 2/2001 | Maekawa et al. | 53/204 |
| 6,247,294 | B1 | * | 6/2001 | Suolahti | 53/588 |

FOREIGN PATENT DOCUMENTS

| | | | | |
|---|---|---|---|---|
| DE | 15732 | * | 4/1956 | 242/434 |
| EP | 544 312 A1 | | 6/1993 | |
| EP | 936 142 A2 | | 8/1999 | |
| JP | 363117883 | * | 5/1988 | 242/434.5 |
| SU | 847385 | * | 7/1981 | 242/434 |

* cited by examiner

*Primary Examiner*—Emmanuel Marcelo
(74) *Attorney, Agent, or Firm*—Flynn, Thiel, Boutell & Tanis, P.C.

(57) ABSTRACT

A coil wrapping machine having an annular frame with a track encircling an opening in the frame. A carriage assembly is mounted for movement on the track around the opening, the carriage being configured to dispense wrapping material onto the coil. An endless flexible strand is provided on the frame and extends around the opening adjacent the track and is coupled to a drive motor so that the flexible strand is driven circumferentially of the opening and causes a corresponding movement of the carriage assembly fastened thereto. The coil is mounted on a support with a control being provided for controlling the relative speed of movement between the part of the coil moving through the opening in the frame and, simultaneously, a speed of movement of the carriage assembly around the track.

15 Claims, 12 Drawing Sheets

COIL WRAPPING MACHINE

This Application claims the benefit of Provisional Application No. 60/169,070, filed Dec. 6, 1999.

FIELD OF THE INVENTION

This invention relates to a coil wrapping machine.

BACKGROUND OF THE INVENTION

Once sheet metal has been rolled into a coil, preventing the coil from being affected by the environment necessitates the coil being wrapped in an appropriate wrapping material.

It is an object of this invention to provide a durable and simple to operate coil wrapping machine.

SUMMARY OF THE INVENTION

The object and purpose of this invention is met by providing a coil wrapping machine which has an annular frame with a track encircling an opening in the frame. A carriage assembly is mounted for movement on the track around the opening, the carriage being configured to dispense wrapping material onto the coil. An endless flexible strand is provided on the frame and extends around the opening adjacent the track and is coupled to a drive motor so that the flexible strand is driven circumferentially of the opening and causes a corresponding movement of the carriage assembly fastened thereto. The coil is mounted on a support with a control being provided for controlling the relative speed of movement between the part of the coil moving through the opening in the frame and, simultaneously, a speed of movement of the carriage assembly around the track.

DETAILED DESCRIPTION

Figure 1:
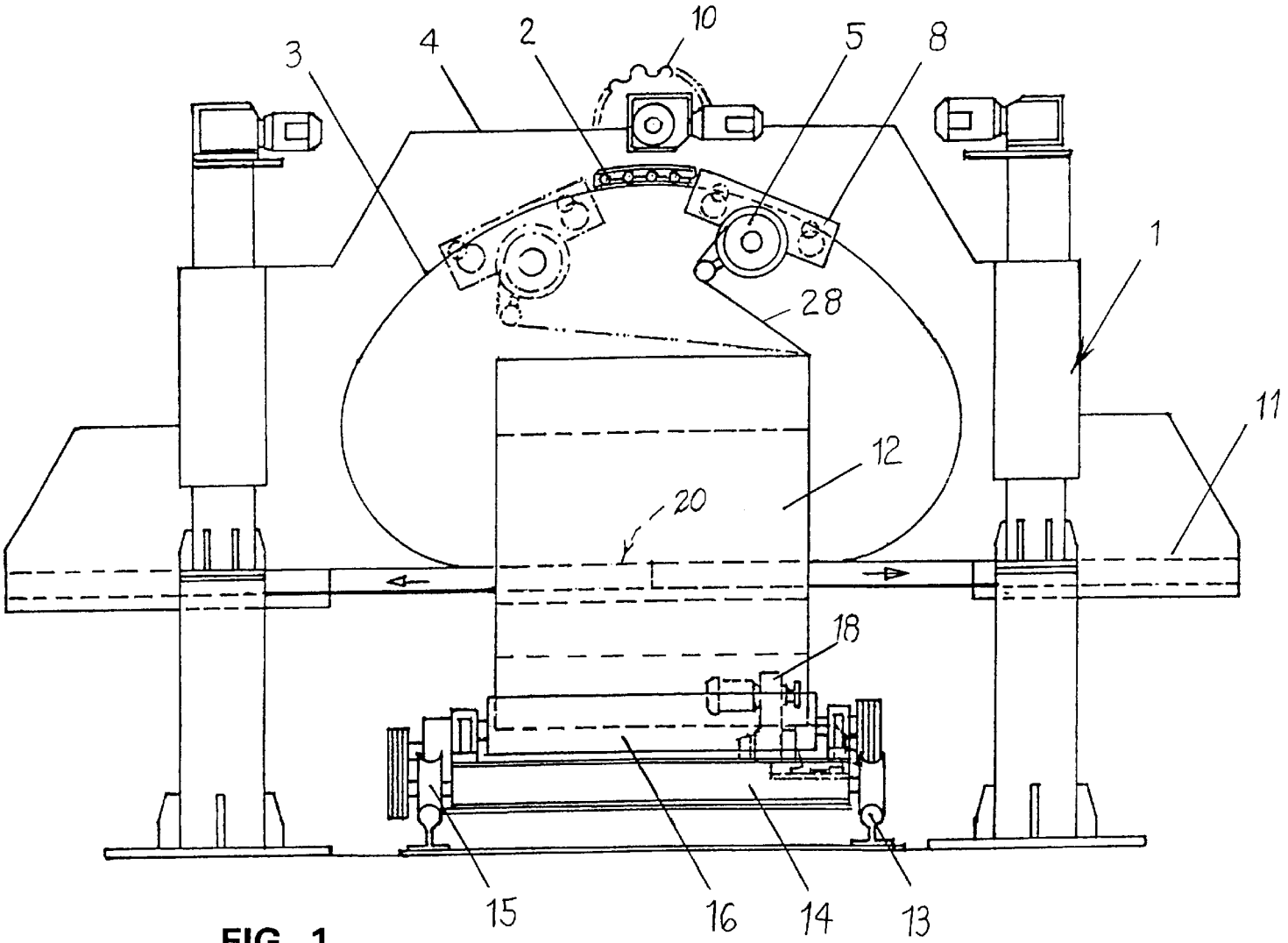
FIG. 1 is a front view of a coil wrapping machine embodying the invention.
Figure 2:
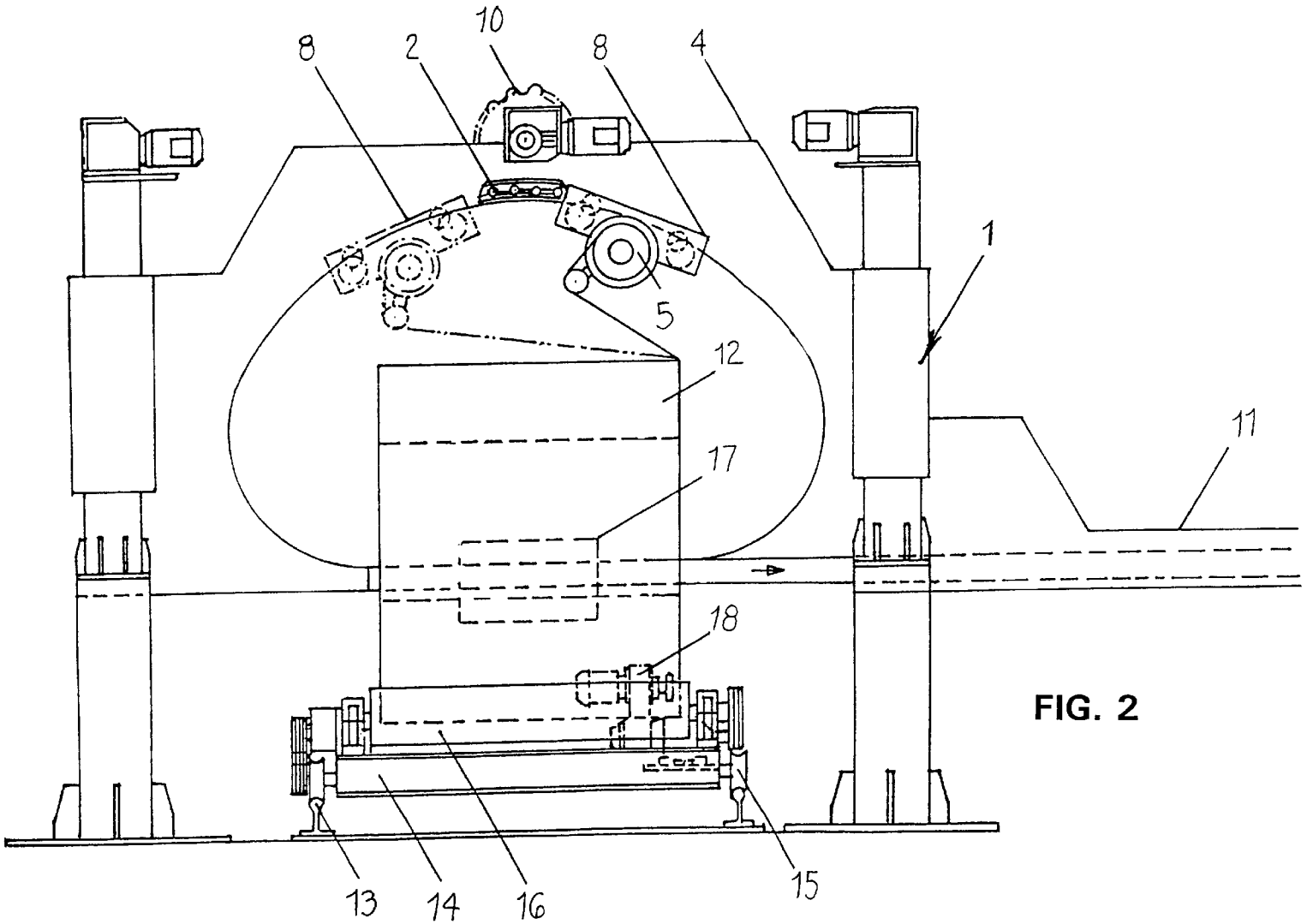
FIG. 2 is a front view similar to FIG. 1.
Figure 3:
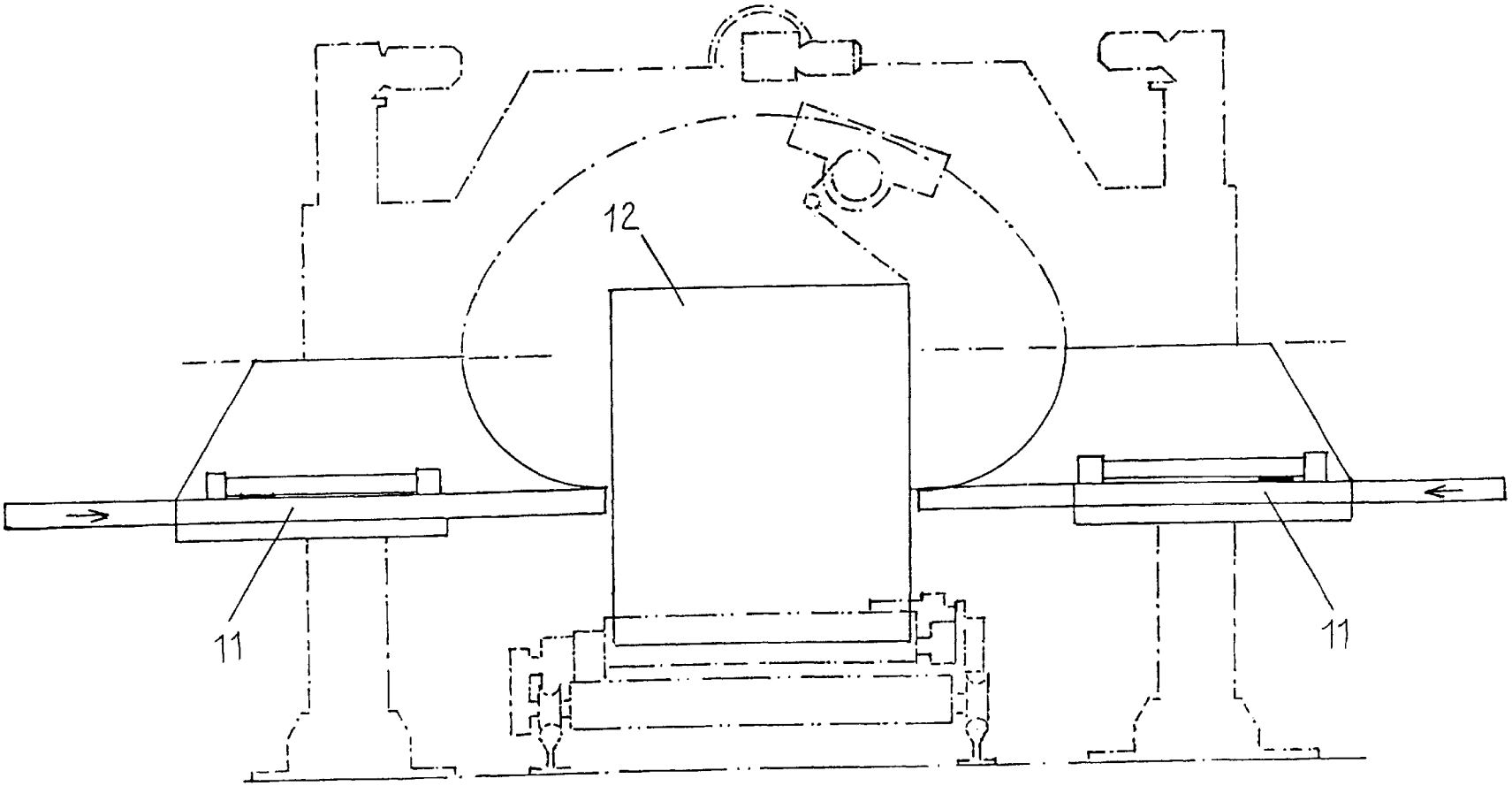
FIG. 3 is a front view similar to FIGS. 1 and 2, but with the bridge being shown in the retracted position.
Figure 4:
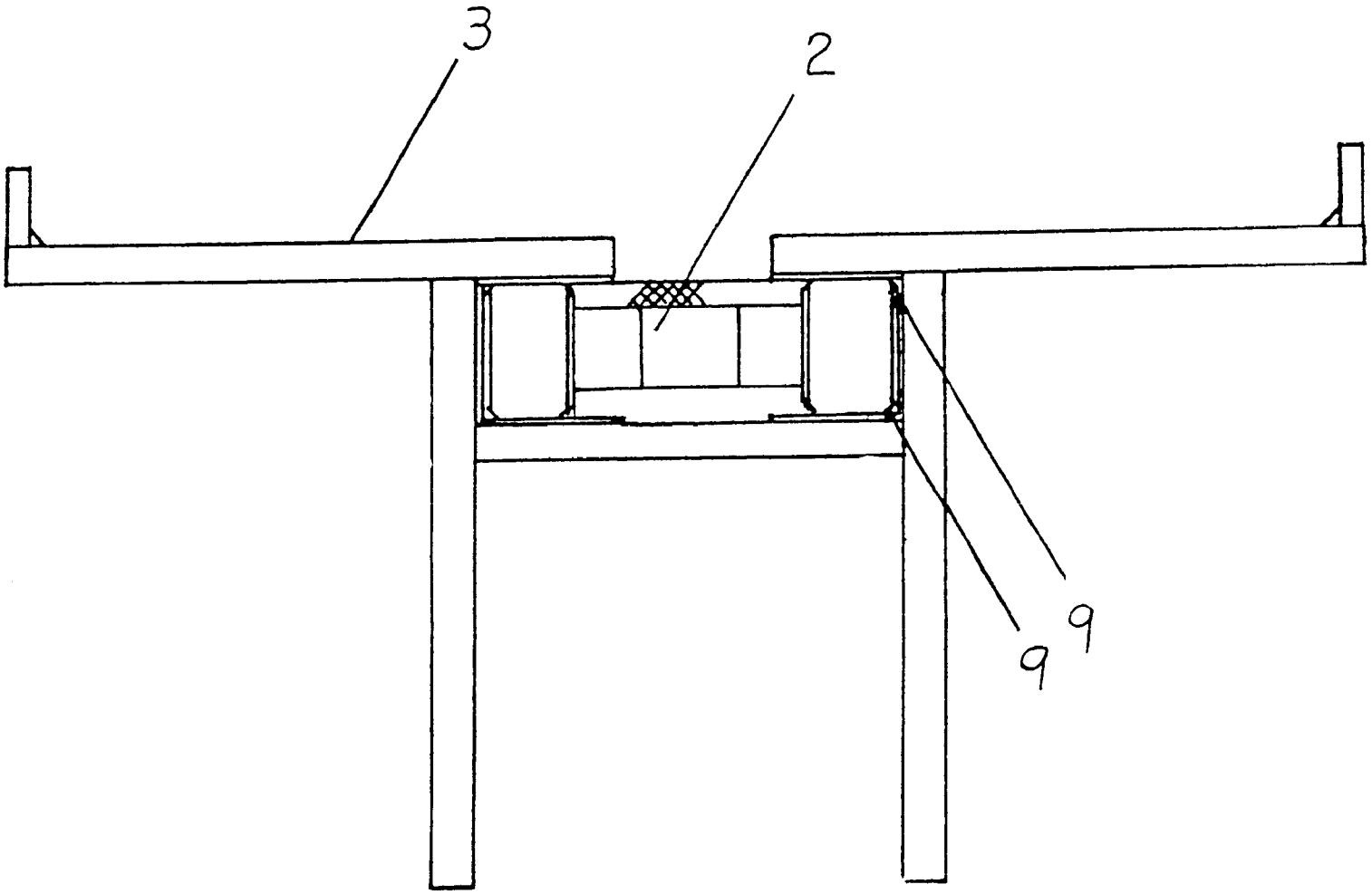
FIG. 4 is a sectional view through the chain and support therefor.

This invention of, for example, a sheet metal coil wrapping machine 1, as shown on FIGS. 1–3, 6–13, consists of one or more tape dispensers or carriage assemblies 8, that describe a non-uniform movement dragged by an endless flexible strand 2 in the form of a chain 2, or cable, or belt (or any flexible structure) longitudinally guided along the profile (as per FIG. 4, Ref. 3) that forms the structure of the frame or arch 4 of the wrapping machine, and applies the material(s) 28 supported on a wrapping material holder 5 and specified to wrap the coil 12.

The endless flexible strand or chain 2 is sectioned or separated at a specific link by a hydraulic, pneumatic or electric system (FIG. 2, Ref. 17, see also the servos 30, 31 and 32 in FIG. 11) that permits or allows for the opening of the bridge 20 of the arch of the machine 4, to permit loading of the coils to be wrapped. This opening can be done on one side or both sides, according to convenience and/or restrictions of the area where the machine will be installed. The re-connection of the chain 2 is done with the same system 17 in reverse operation.

Figures 5A, 5B, 5C:
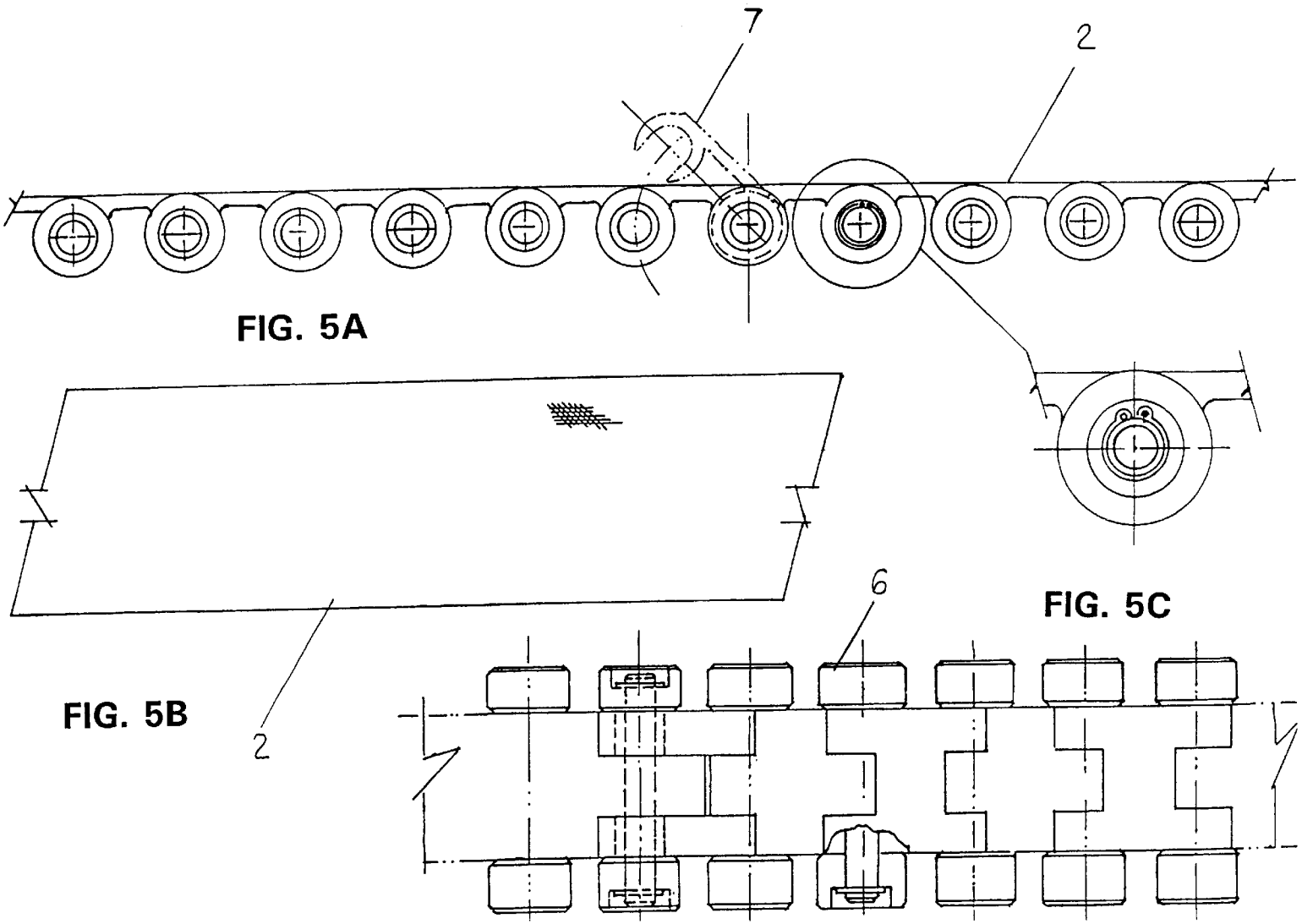
FIGS. 5A to 5C show various details of the chain.

The chain, or flexible structure 2 is specially designed to attend the technical requirements of movement, traction and low friction, can have rolls (FIGS. 5A–5C, Ref. 6) of polyester, or other material that present the same low friction performance. The longitudinal dragging and sectioning of the chain (FIGS. 5A–5C, Ref. 7), allows for the application of one or more wrapping materials 28, because the machine allows for the use of one or more tape dispensers or carriage assemblies 8 being attached to the chain. The internal walls of the channel formed by the guiding profile 3 of the chain 2 (FIG. 4, Ref. 9) are lined with materials with a low rate of friction traction which is simple to install and of low maintenance cost, because the traction unit 10, is external to the arch 4 providing easy access.

FIGS. 3, 11–13 show the bridge opening system 11 that allows the bridge 20 to separate to spaced apart locations 20A and 20B for the feeding of the coils to be wrapped 12 by the lower part of the non-uniform arch 4, permitting loading the coils via a mobile cart 14 driven over closed (or not) circuit tracks 13, perpendicular to the plane of the chain 2 and parallel to the base of the wrapping machine 1. The opening system 11 allows for quick and safe exchange of coils 12 and permits coils to be always in standby to be fed into the machine.

Figure 9:
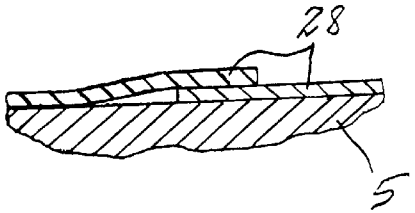
FIG. 9 is a sectional view through a fragment of the coil and the overlapping wrapping thereon.
Figure 10:
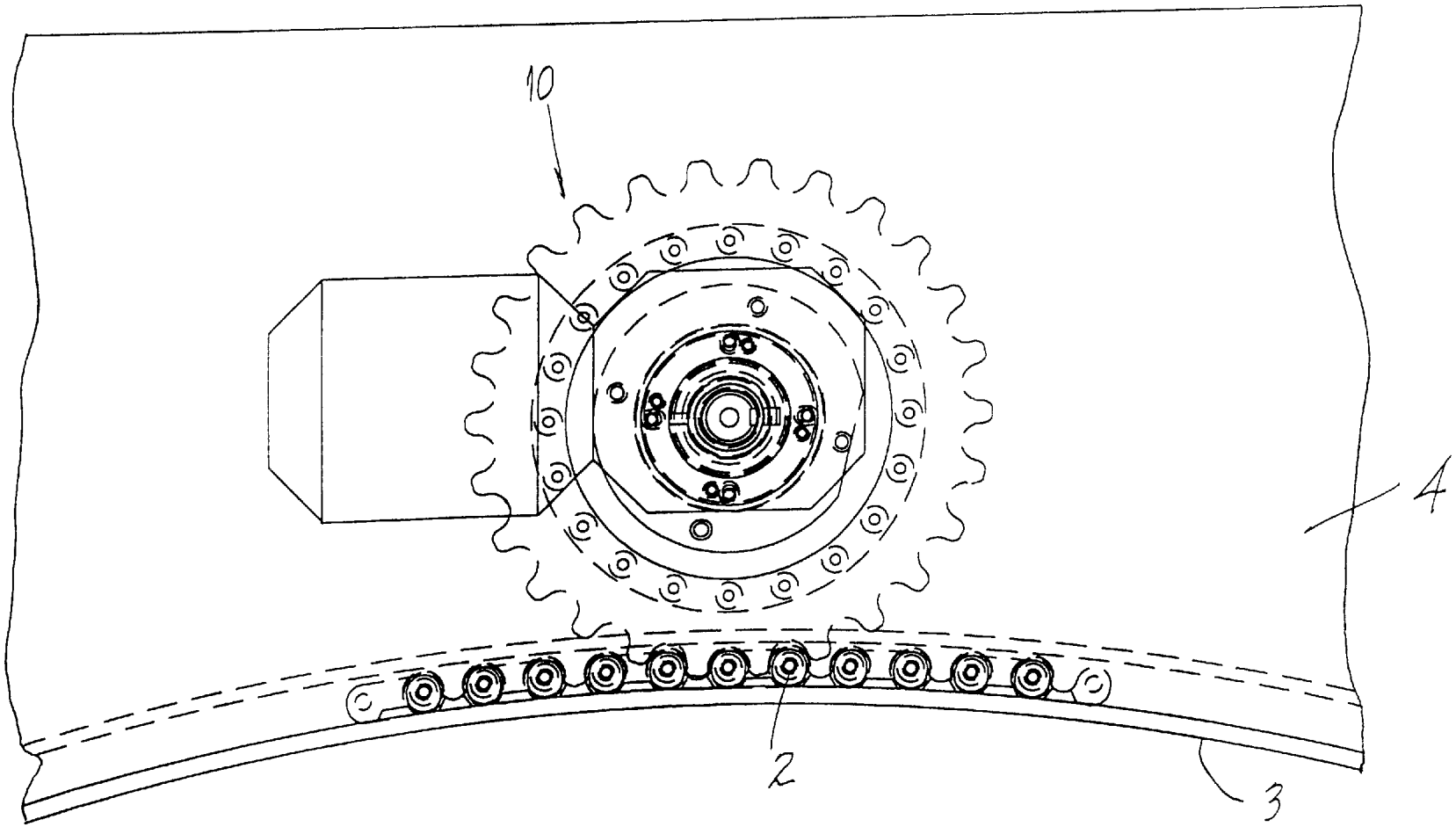
FIG. 10 is an enlarged front view of the chain driving motor illustrated in FIG. 6.
Figure 11:
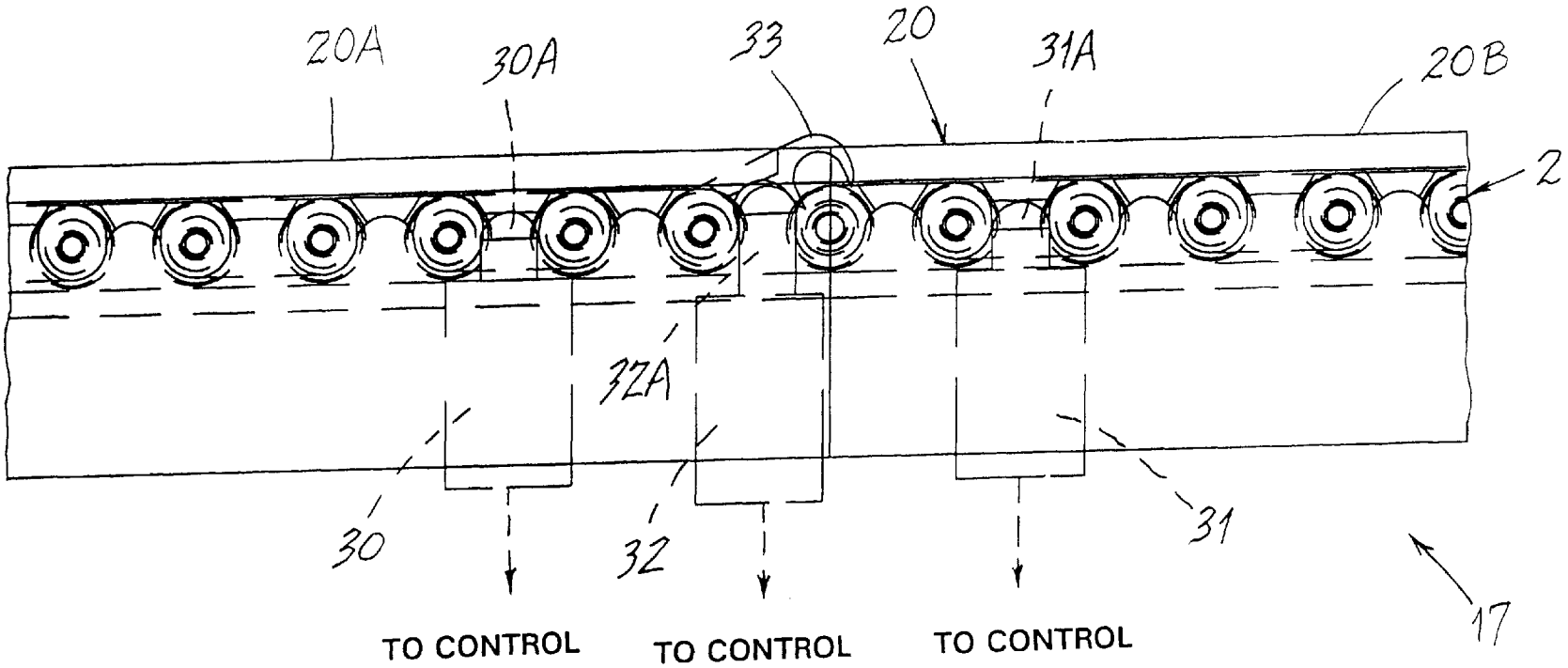
FIG. 11 is a fragmentary view of a section of chain oriented on the bridge.
Figure 12:
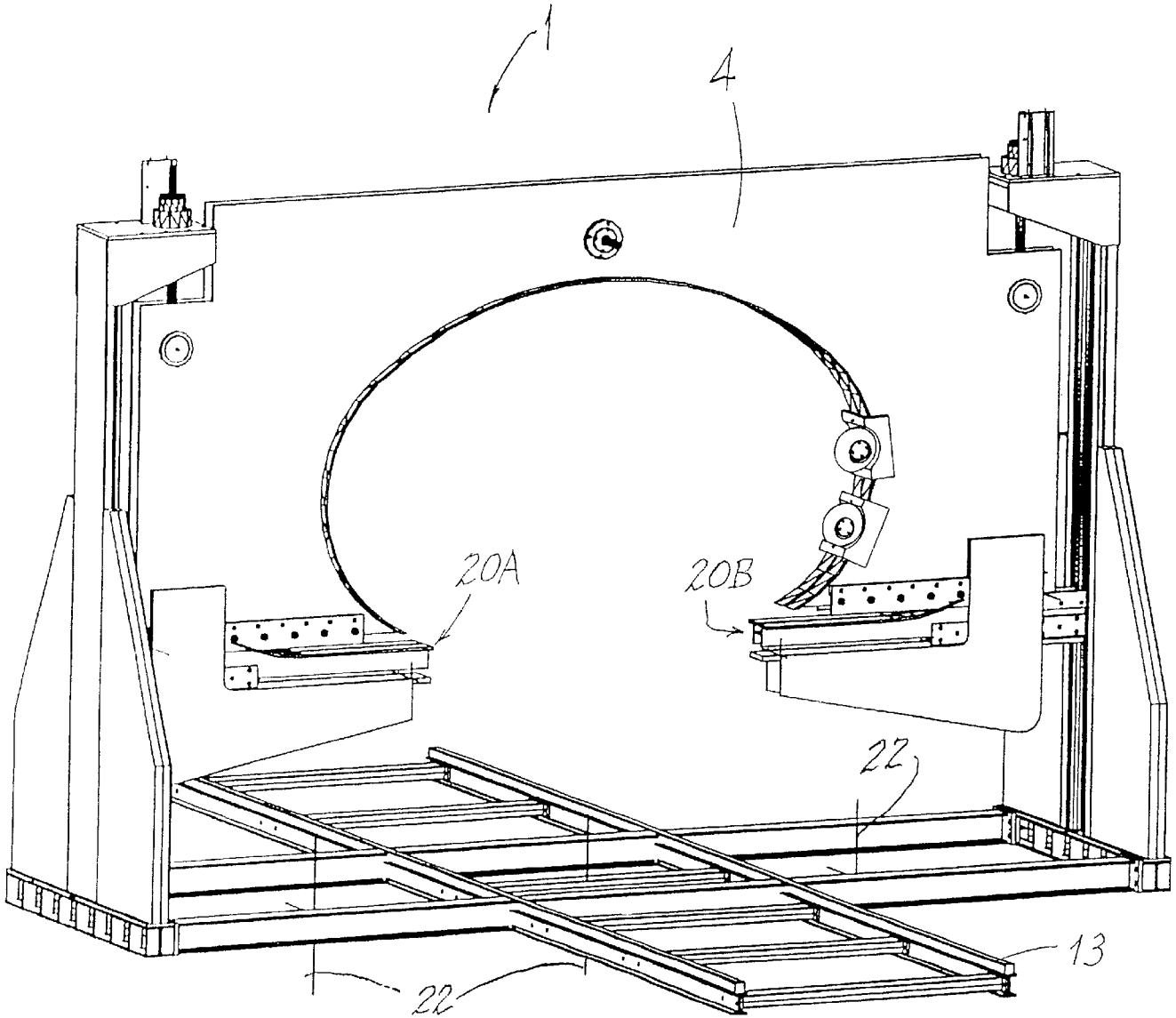
FIG. 12 is a front, left isometric view like FIG. 7, but with the bridge being in the open position.
Figure 13:
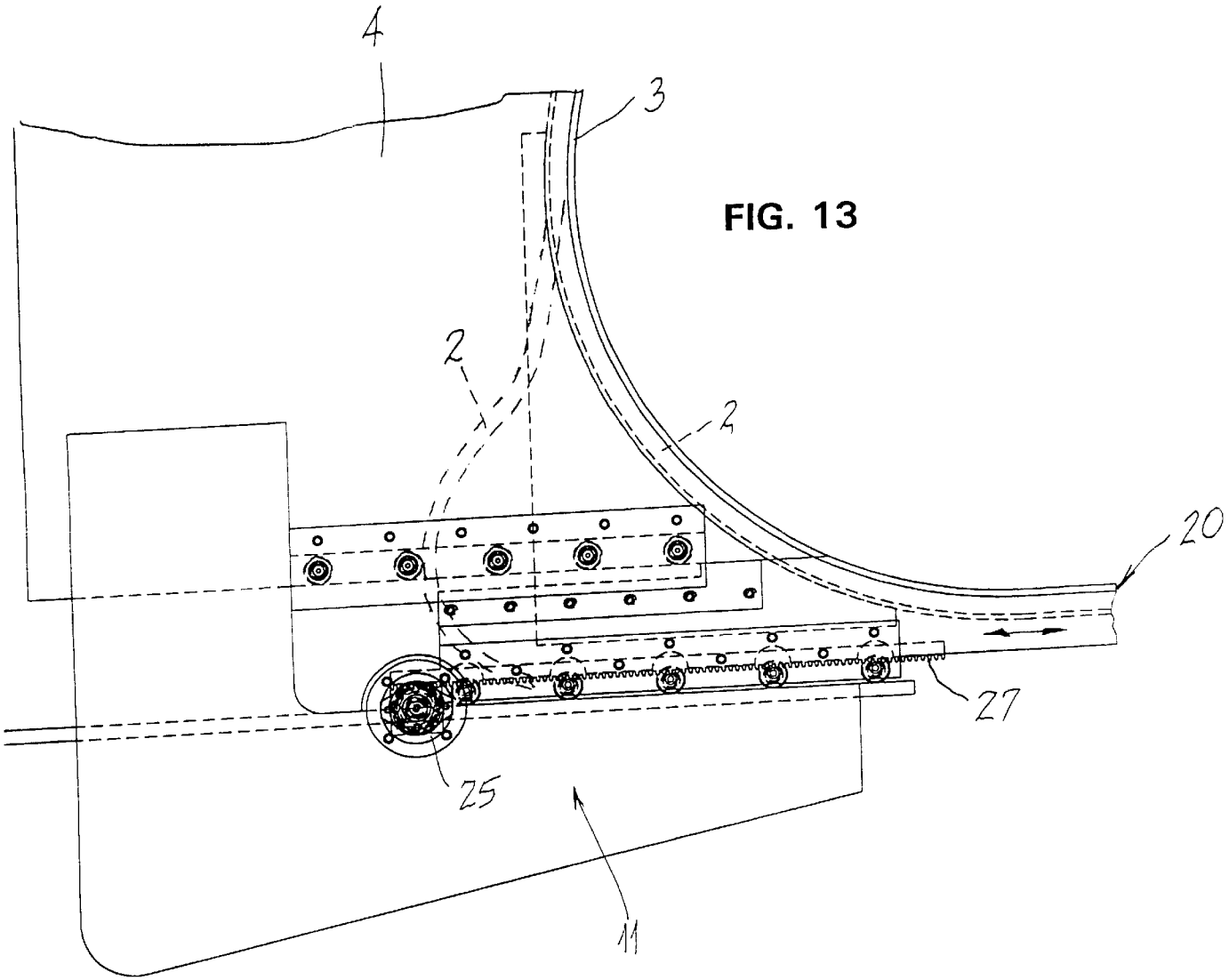
FIG. 13 is an enlarged fragment of a portion of the coil wrapping machine and, in broken lines, the general orientation of the chain following an opening of the bridge.

The mobile coil supporting cart 14 is made out of steel or other materials that offer the same characteristics of support, has wheels 15 that are driven to run on the track circuit 13 (the track circuit has sensors, schematically shown at 22 in FIG. 7, that determine the position of the cart), and have a pair of rolls 16 that support the coils to be wrapped and are driven by mechanical or electronic variable speed system 18 to promote the uniform rotation of the coil being wrapped 12 to produce a uniform layer of slightly overlapped wrapping material 28 as shown partially in FIG. 9.

Figure 6:
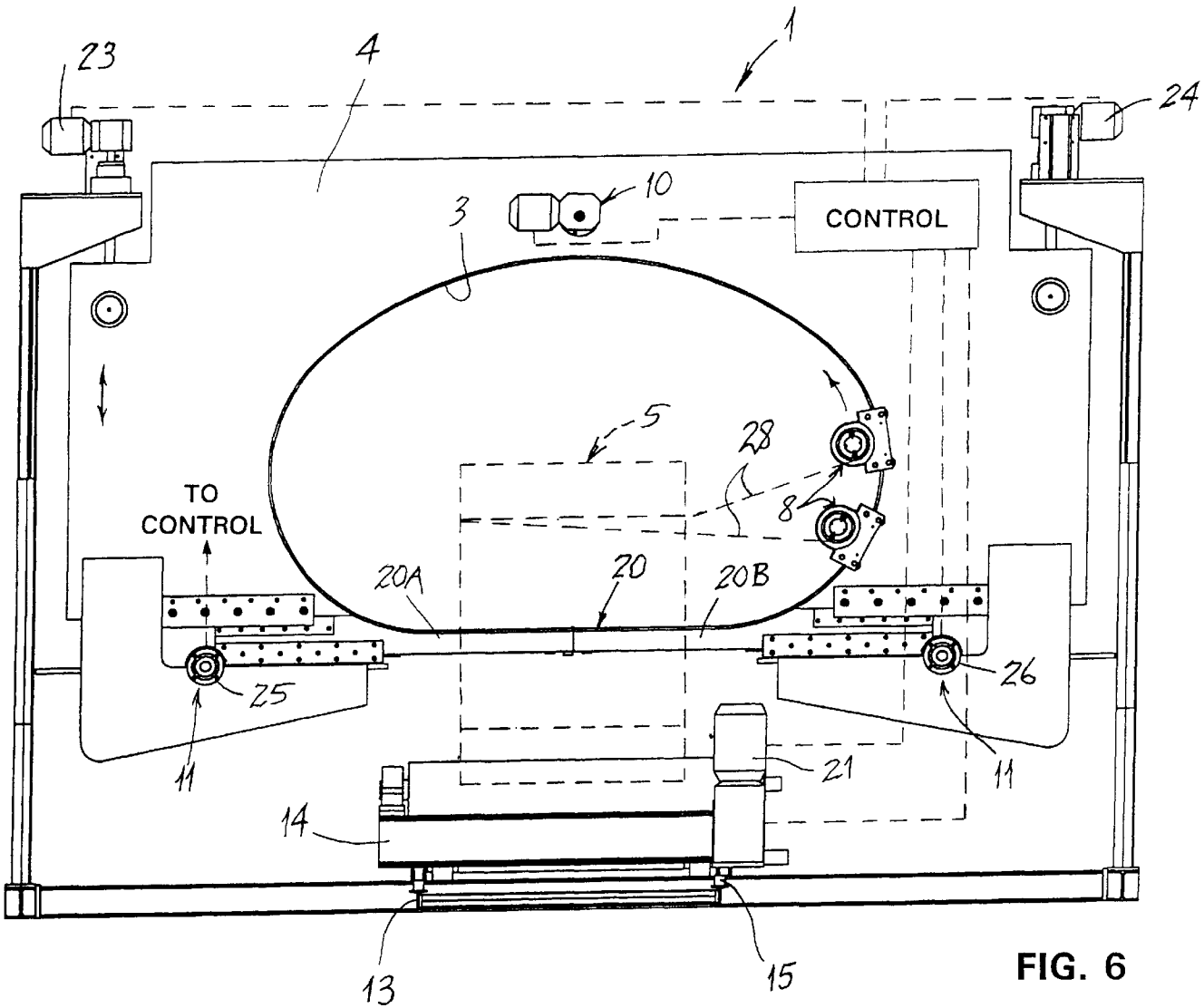
FIG. 6 is a front view similar to FIG. 1, but also illustrating a motor control device.
Figure 7:
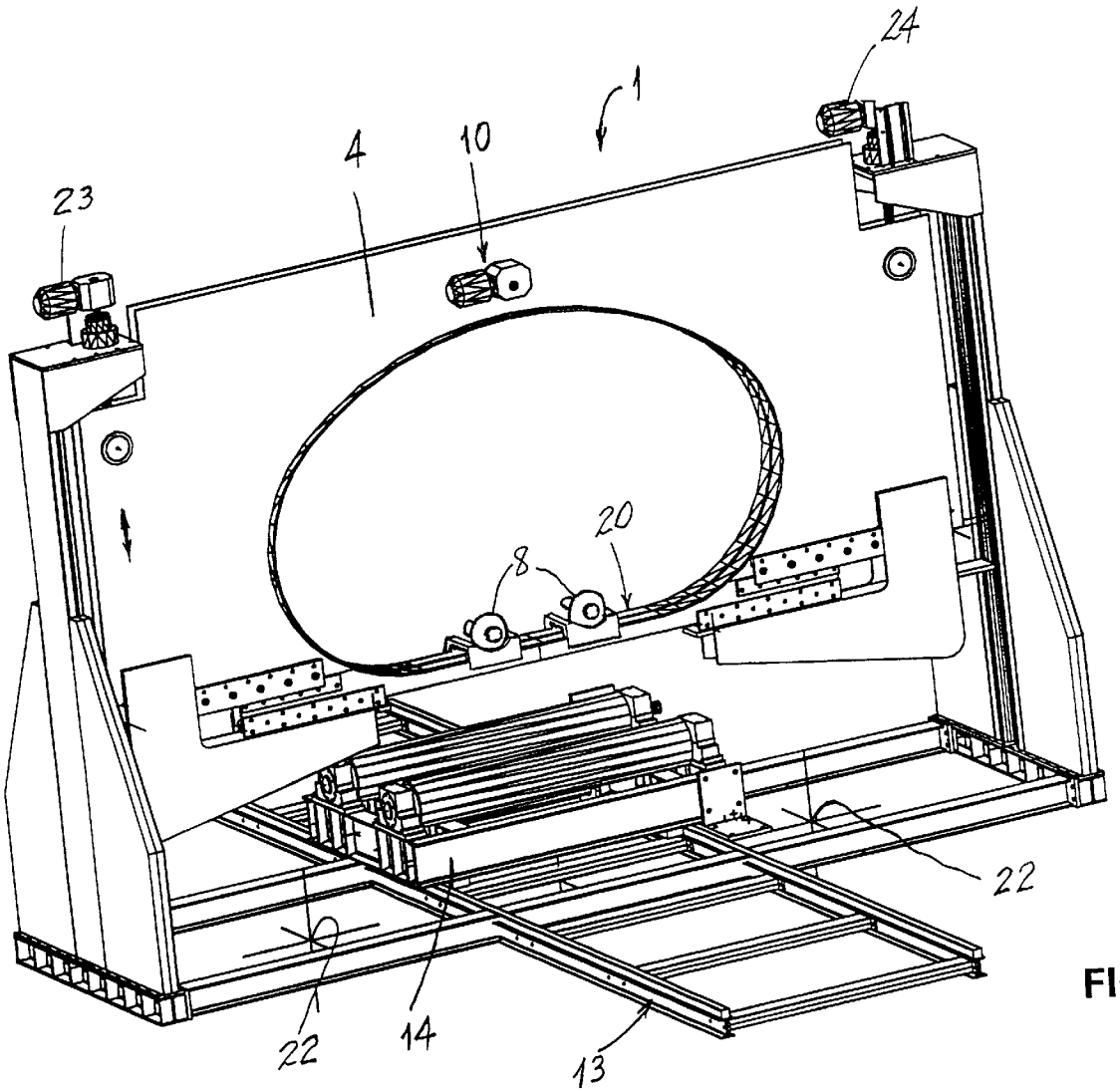
FIG. 7 is a front, left isometric view of the coil wrapping machine.
Figure 8:
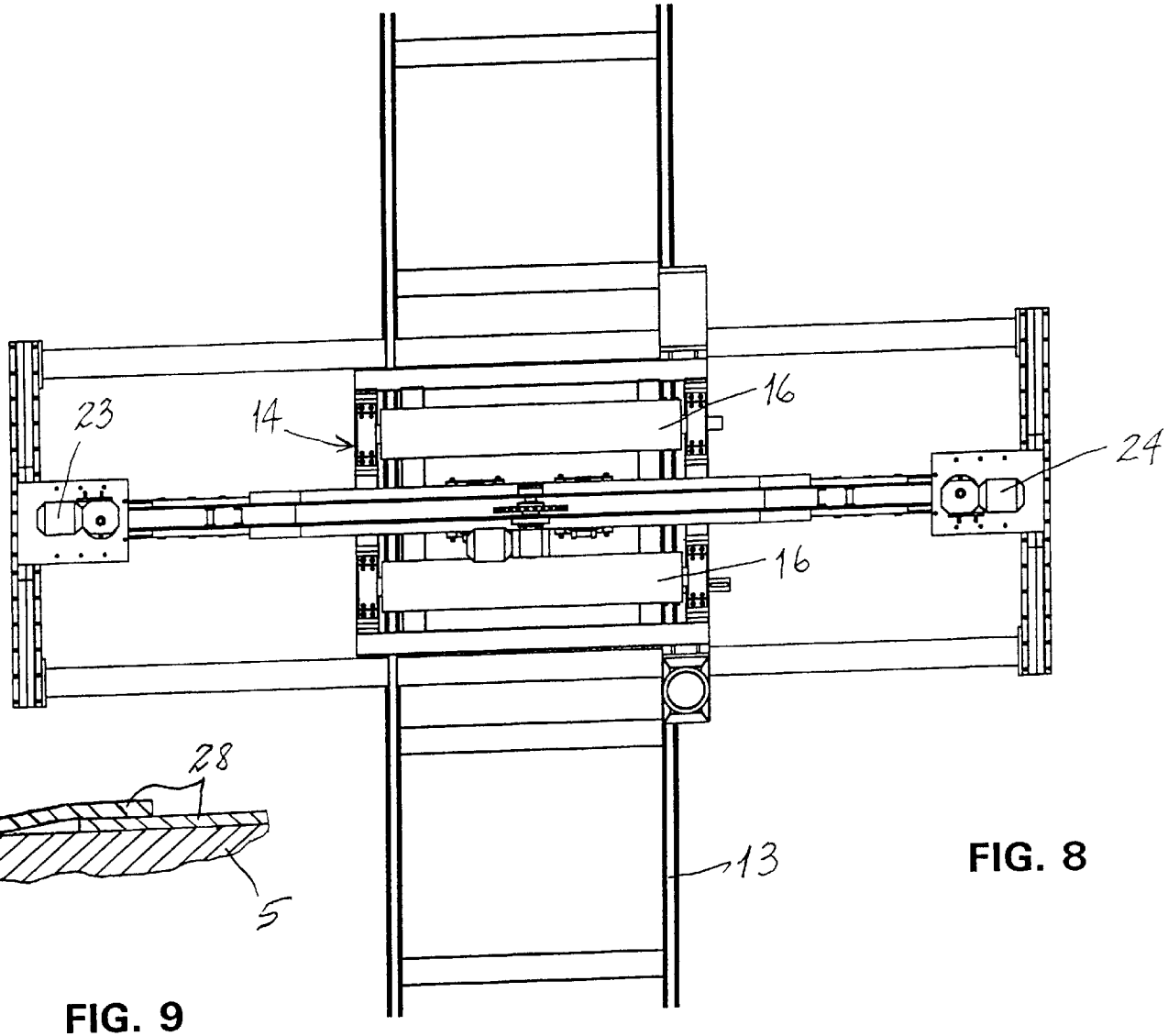
FIG. 8 is a top view of FIG. 6.

A CONTROL, in the form of a manually operable control panel for manually selecting operation parameters for automatic execution, serves to control the speed of the chain driving motor and sprocket 10 and the speed of the motor 21 (FIG. 6) which drive the rolls 16 so that the wrapping material 28 will be evenly applied in a slightly overlapped array to the coil as shown in FIG. 9. The CONTROL is also configured to synchronously and selectively drive motors 23 and 24 to effect a raising and lowering of the frame or arch 4 to determine the level of the bridge 20 with respect to the hollow or central part of the coil. In FIG. 6, the CONTROL is also configured to synchronously drive the motors 25 and 26 of the bridge opening system 11 to cause a gear meshed with a rack 27 (FIG. 13) to separate the bridge parts to the locations 20A and 20B. The CONTROL is also configured to synchronously operate the servos 30 and 31 (FIG. 11) to cause pins 30A and 31A, respectively, thereof to be extended to a position between the links of the chain 2 to lock the chain to the bridge parts prior to opening the bridge. Thereafter, the servo 32 is activated to cause a pin 32A thereof to lift a latch 33 on the chain to separate the chain thereat. The CONTROL is configured to monitor the position of the latch 33 and stop the chain at the break in the bridge so that the latch can be operated by the servo 32.

This invention contemplates the wrapping of any material, and shows best performance when the object to be wrapped is of tubular form.

This wrapping machine stops automatically and permits the easy utilization of lap counters.

What is claimed is:

1. A torroidal coil wrapping machine, comprising:

an annular frame having a track encircling an opening in said frame;

a carriage assembly mounted for movement on said track around said opening, said carriage assembly having a wrapping material holder thereon and configured to dispense wrapping material, when a terminal end of said wrapping material is fastened to a workpiece, in response to movement of said carriage relative to said frame;

a drive motor mounted on said frame;

an endless flexible strand extending around said opening adjacent said track and being drivingly coupled to said drive motor so that said flexible strand is driven circumferentially of said opening, said carriage assembly being fastened to said flexible strand so that movement of said strand imparts a corresponding movement of said carriage assembly with the flexible strand;

a torroidal workpiece support and control means for controlling a relative speed of movement between a part of the torroidal workpiece moving through the opening and, simultaneously, a speed of movement of said carriage assembly around said track, whereby wrapping material on said wrapping material holder fastened to said workpiece will be dispensed from said carriage assembly to effect an orienting of mutually adjacent edges of said wrapping material into an overlapped relation to completely encase said workpiece in said wrapping material.

2. The torroidal coil wrapping machine according to claim 1, wherein said torroidal workpiece support includes a platform supporting said torroidal workpiece on edge so that an axis of a central opening thereof extends horizontally;

wherein said annular frame includes a bridge section extending through said central opening of the torroidal workpiece, said bridge section having an extension of said track thereon for facilitating movement of said carriage assembly and said flexible strand through said central opening.

3. The torroidal coil wrapping machine according to claim 2, wherein said platform is movable so as to impart a rotation of said torroidal workpiece about an axis of rotation extending parallel to an axis of said central opening and relative to said annular frame.

4. The torroidal coil wrapping machine according to claim 2, wherein said platform is provided on a trolley that is supported for movement in a direction parallel to said axis of said central opening;

wherein said bridge section includes support means supporting said bridge section for retraction from said central opening; and wherein said control means is configured to allow movement of said trolley to a position whereat said central opening is aligned to receive said bridge section therethrough only when said bridge section is in a retracted position.

5. The torroidal coil wrapping machine according to claim 4, wherein said trolley has location indicating means thereon; and wherein said control means is configured to effect a stopping of said trolley in response to a signal specific of said location indicating means.

6. The torroidal coil wrapping machine according to claim 1, wherein said annular frame is comprised of a pair of horizontally spaced and parallel plates between which said flexible strand is guided.

7. A torroidal coil wrapping machine, comprising:

an annular frame having a track encircling an opening in said frame;

a carriage assembly mounted for movement on said track around said opening, said carriage assembly having a wrapping material holder thereon and configured to dispense wrapping material, when a terminal end of said wrapping material is fastened to a workpiece, in response to movement of said carriage relative to said frame;

a drive motor mounted on said frame;

an endless flexible strand extending around said opening adjacent said track and being drivingly coupled to said drive motor so that said flexible strand is driven circumferentially of said opening, said carriage assembly being secured to said flexible strand so that movement of said strand imparts a corresponding movement of said carriage assembly;

a torroidal workpiece support and control means for controlling a relative speed of movement between a part of the torroidal workpiece moving through the opening and, simultaneously, a speed of movement of said carriage assembly around said track, said torroidal workpiece support including a platform supporting said torroidal workpiece on edge so that an axis of a central opening thereof extends horizontally;

wherein said annular frame includes a bridge section extending through said central opening of the torroidal workpiece, said bridge section having an extension of said track thereon for facilitating movement of said carriage assembly and said flexible strand through said central opening; and wherein said flexible strand includes an unlatchable section to break the endless characteristic of said flexible strand, said control means being configured to always orient said unlatchable section to a specific location on said bridge section before said control activates an unlatching of said flexible strand;

whereby wrapping material on said wrapping material holder fastened to said workpiece will be dispensed from said carriage assembly to effect an orienting of mutually adjacent edges of said wrapping material into an overlapped relation to completely encase said workpiece in said wrapping material.

8. The torroidal coil wrapping machine according to claim 7, wherein said platform is movable so as to impart a rotation of said torroidal workpiece about an axis of rotation extending parallel to an axis of said central opening and relative to said annular frame.

9. The torroidal coil wrapping machine according to claim 7, wherein said bridge section includes a latching means for unlatching said unlatchable section of said flexible strand and a drive means for retracting said bridge section from the central opening of the torroidal workpiece, said control means being configured to effect said retraction of said bridge section in response to said latch means effecting an unlatching of said flexible strand.

10. The torroidal coil wrapping machine according to claim 9, wherein said flexible strand is a chain comprising plural links; and wherein said unlatchable section is defined by two of said links being connected to one another by a latching member.

11. The torroidal coil wrapping machine according to claim 10, wherein said bridge section is comprised of coaxially aligned first and second sections movable toward and away from each other, so that when said sections are moved toward one another, they contact one another to form a continuous bridge section, and wherein a lock for said chain is oriented on each of the opposite sides of said latching member for locking said chain to said first and second sections.

12. The torroidal coil wrapping machine according to claim 11, wherein each said lock is composed of a member with an extendible probe secured to a respective one of said first and second sections, said probe being configured to be received between a selected pair of chain links on each side of said latching member to hold a part of the chain adjacent said latching member fixed to said first and second sections.

13. The torroidal coil wrapping machine according to claim 7, wherein said platform is provided on a trolley that is supported for movement in a direction parallel to said axis of said central opening;

wherein said bridge section includes support means supporting said bridge section for retraction from said central opening; and wherein said control means is configured to allow movement of said trolley to a position whereat said central opening is aligned to receive said bridge section therethrough only when said bridge section is in a retracted position.

14. The torroidal coil wrapping machine according to claim 13, wherein said trolley has location indicating means thereon; and wherein said control means is configured to effect a stopping of said trolley in response to a signal specific of said location indicating means.

15. The torroidal coil wrapping machine according to claim 7, wherein said annular frame is comprised of a pair of horizontally spaced and parallel plates between which said flexible strand is guided.

* * * * *